United States Patent [19]

Aoyama

[11] 4,333,648

[45] Jun. 8, 1982

[54] INFLATABLE GAME BALL

[75] Inventor: Masayoshi Aoyama, Hiroshima, Japan

[73] Assignee: Molten Rubber Industry Co., Ltd., Hiroshima, Japan

[21] Appl. No.: 115,224

[22] Filed: Jan. 25, 1980

[30] Foreign Application Priority Data

Feb. 6, 1979 [JP] Japan ..... 54/11870
Jul. 19, 1979 [JP] Japan ..... 54/90979

[51] Int. Cl.[3] ..... A63B 41/10; A63B 45/00; B65H 81/00

[52] U.S. Cl. ..... 273/65 EB; 156/170; 273/DIG. 8

[58] Field of Search ..... 273/65 EB, 65 E, 58 B, 273/58 BA, DIG. 8; 156/170

[56] References Cited

U.S. PATENT DOCUMENTS

| | | | |
|---|---|---|---|
| 726,503 | 4/1903 | Browning et al. | 273/65 EB |
| 2,023,672 | 12/1935 | Ellis | 273/61 B |
| 2,194,132 | 3/1940 | Voit et al. | 273/65 EB |
| 2,662,771 | 12/1953 | Crowley | 156/170 X |
| 2,761,684 | 9/1956 | Crowley et al. | 273/65 EB |
| 2,789,821 | 4/1957 | Crowley | 273/65 EB |
| 4,191,375 | 3/1980 | Uruba et al. | 273/65 EB |

FOREIGN PATENT DOCUMENTS

| | | | |
|---|---|---|---|
| 52-32292 | 8/1977 | Japan | 273/65 EB |

OTHER PUBLICATIONS

"1966 Spring and Summer, Athletic Equipment", Catalogue by Rawlings, p. 68.

*Primary Examiner*—George J. Marlo
*Attorney, Agent, or Firm*—Armstrong, Nikaido, Marmelstein & Kubovcik

[57] ABSTRACT

In order to improve a touch, this invention provides a ball of the inflatable type comprising a rubber tube used as a ball substrate which is introduced with gas under pressure therewithin, a reinforcing winding layer formed by simultaneously winding the combination of a nylon thread and either an elastic rubber or urethane elastomer thread around the outer periphery of the rubber tube, and a surface cover layer made of a natural or synthetic leather stock which covers the reinforcing winding layer therewith through an adhesive with or without interposing an intermediate rubber layer formed by molding and vulcanization on the peripheral surface of the reinforcing winding layer.

4 Claims, 2 Drawing Figures

INFLATABLE GAME BALL

BACKGROUND OF THE INVENTION

This invention relates to improvements in inflatable athletic balls such as soccer balls, volleyballs and basketballs and more particularly, to balls of the inflatable type with remarkably improved touch.

Conventional athletic balls of the inflatable type can be broadly classified into two groups: One group is a so-called "glued panel ball" in which an inflatable tube or bladder to be an innermost layer is reinforced thereon with a winding of thread, yarn or cord, or reinforced by bonding cotton cloth to the outer surface of the tube and after covering the wound or covered tube with an intermediate rubber layer, it is molded and vulcanized, or an adhesive is directly applied to the reinforcing layer to bond with an outer cover. The other group is a so-called "hand sewn ball" in which quadrants of an outer cover stock are disposed on a rubber tube or bladder and then seamed together to surround the tube with the cover without use of an adhesive. The glued panel ball has generally excellent durability but is much poorer in touch or resiliency than the hand sewn ball. So far as volleyballs of the glued panel type are concerned, the ball of a nylon thread winding construction is superior several times in durability, but is poor in touch as compared with the ball of a cotton cloth-reinforcing construction. Since, for volleyballs and footballs, importance is attached to their touch, the glued panel type of balls are frequently shunned by players.

Several improvements in touch of these glued panel types of balls have been already known including an improvement in which the reinforcing layer is constituted of a three-layer construction as disclosed, for example, in Japanese Patent Publication No. Sho 48-40024 and an improvement directed to a reinforced construction by windings of two kinds of threads which are different in modulus of elongation (or modulus of elasticity) as proposed in Japanese Patent Publication No. Sho 52-32292.

However, these two improving methods concerning the touch of the glued panel type of balls are very complicated to fabricate and do not show any remarkable improving effects, and are accordingly not reduced into practice now.

As stated before, the glued panel ball of the thread winding construction has a vital drawback that its touch is poor. Extensive studies have been made to improve this touch characteristic and as a result, it has been found that when a urethane elastomer thread (spandex) or a rubber thread which has never been employed up to now as an elastic thread material of prior-art balls reinforced by thread windings is incorporated in the reinforcing winding layer of the inflatable ball of the reinforcing winding type, an extremely good touch can be imparted to the ball. The present invention is completed based on the above finding.

In fabricating an inflatable ball of the reinforcing winding type, when a urethane elastomer thread or a rubber thread is used in combination with a conventionally employed nylon filament or a polyester filament thread and is wound at random about a ball substrate together with the reinforcing filament, the touch of the ball is pronouncedly improved since the urethane elastomer thread or rubber thread wound at random in the reinforcing winding layer is able to absorb high impact force while keeping the excellent durability of the winding-reinforced construction at a sufficiently high level.

SUMMARY OF THE INVENTION

An object of the present invention is to provide balls of the inflatable type which have remarkably improved touch while retaining, as it is, an excellent durability characteristic of a winding-reinforced construction of prior-art balls of the glued panel type.

In order to achieve the above object, there is provided according to the invention a ball of an inflatable type which comprises an inflatable hollow rubber tube or bladder used as a ball substrate or core into which is introduced a gas under pressure, a reinforcing winding layer formed by winding a reinforcing filament thread and an elastic thread simultaneously along the outer periphery of the rubber tube, and an outer cover layer covering the reinforcing winding layer therewith by means of an adhesive with or without an intervening intermediate rubber layer therebetween, the outer cover layer being made of a natural leather or a synthetic leather stock.

According to the invention, the reinforcing filament thread is at least one member selected from the group consisting of nylon filament threads, polyester filament threads, crimped threads of other synthetic fibrous filaments, a cotton thread, mixed spun threads of cotton and synthetic fibers, and the elastic thread is a urethane elastomer thread or a rubber thread.

BRIEF DESCRIPTION OF THE DRAWINGS

The above and other objects, features and advantages of the present invention will become more clear from the following description with reference to the accompanying drawings, in which.

DETAILED DESCRIPTION OF THE PREFERRED EMBODIMENTS

Figure 1:
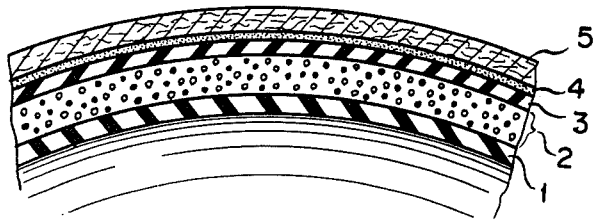
FIG. 1 is a schematical view showing a part, longitudinally sectioned, of a ball of the inflatable type according to the invention having an intermediate rubber layer between a reinforcing winding layer and an outer cover layer.

Referring to FIG. 1, there is shown a rubber tube or bladder, indicated at 1, to be a ball substrate or core into which a gas is introduced under pressure. Along the outer periphery of the tube 1 are wound at random a reinforcing filament thread and an elastic thread under slight tension as not to loosen the threads to form a reinforcing winding layer 2. The elastic thread is, for example, a urethane elastomer thread (spandex) or a rubber thread. Because of a smoothness of the surface of a finished ball and a smoothness in unwinding from a reel during the process of fabrication of balls, the rubber thread is rather preferable. In the practice of the invention, either a rubber thread obtained from a natural or synthetic rubber latex, or a rubber thread obtained by cutting from a raw rubber sheet may be used. The suitable rubber thread should have the following physical properties:

| | |
|---|---|
| Breaking strength (tensile strength) | 330 ~ 380 kg/cm$^2$ |

-continued

| | |
|---|---|
| Breaking elongation (modulus of elongation) | 770 ~ 900% |
| 500% modulus (modulus of elasticity) | 35 ~ 84 kg/cm$^2$ |
| Specific gravity | 0.92 ~ 1.04 g/cm$^3$ |
| Diameter of thread | less than 0.21 mm |

The reinforcing filament thread used in combination with the elastic thread is not necessarily limited to one of synthetic fibers such as a nylon filament thread and a polyester filament thread but may be co-used with one or more of members selected from the group consisting of other fibers having a smaller modulus of resilience than the nylon filament thread, for instance, crimped threads of synthetic fibrous filaments, cotton thread and mixed spun threads of cotton and synthetic fibers.

In the first embodiment according to the invention shown in FIG. 1, an intermediate rubber layer 3 is formed by molding vulcanization on the surface of the reinforcing winding layer 2 in a manner as mentioned above. Then, an outer cover 5 of a natural leather or synthetic leather stock is applied as an outermost layer by being bonded to the intermediate layer 3 through a suitable adhesive layer 4.

Figure 2:
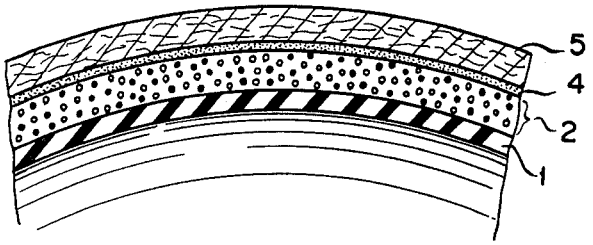
FIG. 2 is a schematical view showing a part, longitudinally sectioned, of a ball of the inflatable type according to the invention having no intermediate rubber layer.

FIG. 2 shows another embodiment according to the invention. The ball of the second embodiment is fabricated in a manner similar to the first embodiment except that the intermediate layer 3 is not formed. Accordingly, the layers corresponding to the respective layers of the first embodiment are indicated by similar reference numerals.

Examples will be described in which balls are fabricated according to either of the first or second embodiment. It is to be noted that the evaluation of touch of Examples 1 through 3 and 6 was made by panels of the members of a volleyball club who are in the employ of the company to be an asignee of this application and who have an athletic history in playing volleyball for a period of 10 to 15 years. The evaluation of touch of Examples 4 and 5 was made by the present inventor.

EXAMPLE 1

The fabrication and properties of balls in this example are as follows.

A gas-inflated, butyl rubber tube with a diameter of 200 mm was wound on the outer surface thereof with each of combinations of a nylon 66 filamentous thread (breaking strength of 540 g, breaking elongation of 28%) made of two twisted yarns with a size of 50 deniers and a commercially available urethane elastomer thread (strength of 1.3 g/denier, breaking elongation of 490%), of a thread (breaking strength of 610 g, breaking elongation of 20%) of two twisted polyester filmentous yarns with a size of 50 deniers and a urethane elastomer thread, of a 50 denier nylon 66 thread (breaking strength of 300 g, breaking elongation of 26%) and a urethane elastomer, and the like combinations. A pair of the threads were wound simultaneously in a way of endless tracks to form a reinforcing winding layer. Then, an intermediate layer of natural rubber was molded and vulcanized to surround the outer surface of the reinforcing winding layer. After applying an adhesive to the intermediate layer, a natural leather cover stock with a thickness of 1.5 mm was bonded to the intermediate layer through the adhesive to obtain #5-size volleyball Nos. 1–5. The results of performance in employment of the volleyballs as well as a prior art article for comparative purposes are shown in Table 1, in which the tests and the evaluation of each ball are conducted as follows. This is also applied to Examples 2 and 3.

(1) The touch is evaluated by averaging feelings of the experts, indicated by alphabetic expressions, at the times of spiking and receiving a test ball (The touch becomes poorer in the order of A, B, C and D).

(2) The durability is the number of repetitions of a 33% compressive deformation imposed on a test ball with an internal pressure of 0.5 kg/cm$^2$ at a rate of 120 r.p.m. until it is punctured.

(3) The height of bound is indicated by a height of the top of a bounded ball when it is naturally dropped from a height of 1.8 m to a concrete floor under conditions of an internal pressure of 0.48 kg/cm$^2$ and a temperature of 23° C.

EXAMPLE 2

On the outer surface of a tube as in Example 1 were simultaneously wound such a nylon 66 filamentous twisted thread and a urethane elastomer thread as used in Example 1 and also a thread selected from a nylon 6 crimped thread, a polyester crimped thread, a cotton thread and a mixed spun thread (mixing ratio of 50/50) of cotton and nylon. Thereafter, an intermediate rubber layer was molded and vulcanized on the surface of the reinforcing winding layer, followed by bonding a natural leather cover stock of 1.5 mm in thickness to the rubber surface to obtain #5 size volleyball Nos. 6–9. The test results are shown in Table 2.

EXAMPLE 3

On the surface of a tube as in Example 1 a reinforcing winding layer made of such thread materials as used in Example 1 was wound by a procedure shown in Table 3. Without forming an intermediate rubber layer, a rubber adhesive was directly applied on the entire surface of the reinforcing winding layer for bonding with a cover stock of a natural or synthetic leather of 1.5 mm in thickness to fabricate #5 size volleyball Nos. 10–13, with the test results shown in Table 3.

EXAMPLE 4

This example illustrates fabrication of #5 size soccer balls.

A gas-inflated butyl rubber tube with a diameter of 211 mm was wound on its outer surface with a 70 denier thread of two twisted nylon 66 filaments (breaking strength of 840 g, breaking elongation of 26%) and a commercially available urethane elastomer thread (spandex filamentous thread) so that the both threads drew endless tracks simultaneously and in parallel. Then, an intermediate natural rubber was molded and vulcanized on the reinforcing winding layer, to which was applied an adhesive. Finally, a 1.6 mm thick natural or synthetic leather cover stock was bonded to the adhesive-applied layer to make soccer ball Nos. 14–16 of the above-mentioned size.

The results of performance in employment of the soccer balls are shown in Table 4 along with those of a comparative prior-art article.

It is to be noted that the tests for or the evaluation of the balls are conducted as follows.

(1) The touch is evaluated on the basis of feelings created on kicking a test ball.

(2) The durability is indicated by the number of repetitions of the compressive deformation imposed on a test ball with an internal pressure of 0.6 kg/cm$^2$ under the same conditions as in the case of the volleyballs until it is punctured.

(3) The height of bound means a height of the top of a bounded ball with an internal pressure of 0.6 kg/cm$^2$ when it is dropped under the same conditions as in the case of the volleyballs.

EXAMPLE 5

This example illustrates fabrication of #7 size basketballs.

On the surface of a gas-inflated butyl rubber tube with a diameter of 230 mm were wound a twisted thread (with a size of 70 deniers, two filaments twisted) of nylon filaments and a urethane elastomer thread (strength of 1.35 g/denier, breaking elongation of 510%) in such a manner that the both threads drew endless tracks simultaneously. On the windings were molded and vulcanized an intermediate rubber, on which was applied a rubber adhesive, followed by bonding a pebbled cover stock of a natural or synthetic leather with a thickness of 1.3 mm to make basketball Nos. 17–20.

The test results are shown in Table 5 along with those of a comparative prior-art article. The tests and evaluation are conducted similarly to (1)–(3) in the case of the soccer ball in Example 4.

EXAMPLE 6

This example illustrates fabrication of #5 size volleyballs using a rubber thread as an elastic thread of the reinforcing winding layer.

On the surface of a gas-inflated butyl rubber tube with a diameter of 200 mm were simultaneously wound a nylon 66 twisted thread with a size of 50 deniers/1×2 (breaking strength of 550 g, breaking elongation of 30%) and a latex rubber thread (breaking strength of 380 kg/cm$^2$, breaking elongation of 880%, 500% modulus of 45 kg/cm$^2$) with or without use of another nylon crimped thread.

Then, an intermediate rubber layer incorporated with natural rubber was molded and vulcanized on the winding layer, to which was applied an adhesive, followed by bonding a cover stock of a natural or synthetic leather to make volleyball Nos. 21–24. The test results of these volleyballs are shown in Table 6 together with those of a comparative prior-art article. The tests and the evaluation are the same as in the case of Example 1.

TABLE 1

| Ball No. | Reinforcing winding layer: Type of thread | Amount of thread (the number of times of winding) | Manner of winding | Touch (feeling) | Durability (ten thousands times) | Height of bound (cm) | Weight of ball (g) |
|---|---|---|---|---|---|---|---|
| 1 | Nylon 50 deniers/2<br>Urethane elastomer thread 140 deniers | 2,100<br>700 | Simultaneous windings | A | above 50 | 143.3 | 267 |
| 2 | Nylon 50 deniers/2<br>Urethane elastomer thread 280 deniers | 2,100<br>700 | Simultaneous windings | A | above 50 | 144.5 | 270 |
| 3 | Nylon thread 50 deniers<br>Urethane elastomer thread 140 deniers | 4,000<br>1,000 | Simultaneous windings | A | above 50 | 143.1 | 266 |
| 4 | Urethane elastomer thread 140 deniers<br>Nylon thread 50 deniers/2 | 700<br>2,100 | Windings in separate layers | B | above 50 | 138.2 | 268 |
| 5 | Polyester 50 deniers/2<br>Urethane elastomer thread 140 deniers | 1,800<br>600 | Simultaneous | B | 20 | 144.6 | 264 |
| Prior art article | Nylon 50 deniers/2 | 2,800 | | C or D | above 50 | 136.0 | 271 |

TABLE 2

| Ball No. | Reinforcing winding layer: Type of thread | Amount of thread (the number of times of winding) | Manner of winding | Touch (feeling) | Durability (ten thousands times) | Height of bound (cm) | Weight of ball (g) |
|---|---|---|---|---|---|---|---|
| 6 | Nylon 50 deniers/2<br>Nylon 6 crimped thread 100 deniers<br>Urethane elastomer thread 140 deniers | 2,100<br>700<br>700 | Simultaneous windings | A or B | above 50 | 138.4 | 270 |
| 7 | Nylon 50 deniers/2<br>Polyester crimped thread 150 deniers<br>Urethane elastomer thread 140 deniers | 2,100<br>700<br>700 | Simultaneous windings | B | above 50 | 137.3 | 272 |
| 8 | Nylon 50 deniers/2<br>Cotton thread No. 30<br>Urethane elastomer | 2,100<br>700<br>700 | Simultaneous windings | B | above 50 | 136.5 | 272 |

TABLE 2-continued

| Ball No. | Reinforcing winding layer: Type of thread | Amount of thread (the number of times of winding) | Manner of winding | Touch (feeling) | Durability (ten thousands times) | Height of bound (cm) | Weight of ball (g) |
|---|---|---|---|---|---|---|---|
| 9 | thread 140 deniers<br>Nylon 50 deniers/2<br>Cotton/nylon mixed spun thread No. 20<br>Urethane elastomer thread 140 deniers | 2,100<br>700<br>700 | Simultaneous windings | A or B | above 50 | 137.0 | 274 |

TABLE 3

| Ball No. | Reinforcing winding layer and cover surface: Type of thread | Amount of thread (the number of times of winding) | Manner of winding | Touch (feeling) | Durability (ten thousands times) | Height of bound (cm) | Weight of ball (g) |
|---|---|---|---|---|---|---|---|
| 10 | Nylon 50 deniers/2<br>Urethane elastomer 140 deniers | 2,100<br>700 | Simultaneous windings, synthetic leather bonded | A | Above 50 | 142.9 | 261 |
| 11 | Nylon raw thread 50 deniers<br>Nylon elastomer thread 140 deniers | 4,000<br>1,000 | Simultaneous windings, synthetic leather bonded | A | Avove 50 | 142.8 | 265 |
| 12 | Nylon raw thread 50 deniers<br>Nylon elastomer thread 140 deniers | 1,000 | Simultaneous windings, synthetic leather bonded | A | Above 50 | 142.0 | 263 |
| 13 | Nylon raw thread 100 deniers<br>Urethane elastomer 140 deniers | 2,800<br>700 | Simultaneous windings, natural leather bonded | B | Above 50 | 139.2 | 266 |

TABLE 4

| Ball No. | Reinforcing winding layer and cover surface: Type of thread | Amount of thread | Manner of winding | Touch (feeling) | Durability (ten thousands times) | Height of bound (cm) | Weight of ball (g) |
|---|---|---|---|---|---|---|---|
| 14 | Nylon 70 deniers/2<br>Urethane elastomer thread 140 deniers | 2,100<br>700 | Simultaneous windings, natural leather bonded | A | above 50 | 135.8 | 428 |
| 15 | Nylon 70 deniers/2<br>Urethane elastomer thread 140 deniers | 2,100<br>700 | Simultaneous windings, synthetic leather bonded | A | above 50 | 133.2 | 427 |
| 16 | Nylon 70 deniers/2<br>Nylon 66 crimped thread 150 deniers<br>Urethane elastomer thread 210 deniers | 2,100<br>700<br>700 | Simultaneous windings, natural leather bonded | B | above 50 | 138.7 | 435 |
| Prior art article | Nylon 70 deniers/2 | 2,800 | Synthetic leather bonded | C | above 50 | 127.5 | 430 |

TABLE 5

| Ball No. | Reinforcing winding layer and cover surface: Type of thread | Amount of thread (the number of times of winding) | Manner of winding | Touch (feeling) | Durability (ten thousands times) | Height of bound (cm) | Weight of ball (g) |
|---|---|---|---|---|---|---|---|
| 17 | Nylon 70 deniers/2<br>Urethane elastomer thread 140 deniers | 2,700<br>900 | Simultaneous windings, natural leather bonded | A | above 50 | 140.5 | 615 |
| | Nylon 70 deniers/2 | 2,700 | Simultaneous | A | above | 142.8 | 621 |

TABLE 5-continued

| Ball No. | Reinforcing winding layer and cover surface: Type of thread | Amount of thread (the number of times of winding) | Manner of winding | Touch (feeling) | Durability (ten thousands times) | Height of bound (cm) | Weight of ball (g) |
|---|---|---|---|---|---|---|---|
| 18 | Urethane elastomer thread 280 deniers | 900 | windings, natural leather bonded | | 50 | | |
| 19 | Nylon 70 deniers/2<br>Urethane elastomer thread 140 deniers | 3,200<br>800 | Simultaneous windings, natural leather bonded | A | above 50 | 141.3 | 619 |
| 20 | Nylon 70 deniers/2<br>Urethane elastomer thread 140 deniers | 2,700<br>900 | Simultaneous windings, synthetic leather bonded | A | above 50 | 139.1 | 616 |
| Prior art article | Nylon 70 deniers/2 | 3,600 | Natural leather bonded | B | above 50 | 136.0 | 618 |

TABLE 6

| Ball No. | Reinforcing winding layer and cover surface: Type of thread | Amount of thread (the number of times of winding) | Manner of winding | Touch (feeling) | Durability (ten thousands times) | Height of bound (cm) | Weight of ball (g) |
|---|---|---|---|---|---|---|---|
| 21 | Nylon 50 deniers/2<br>Rubber thread with a diameter of 0.21cm | 2,100<br>700 | Simultaneous windings, natural leather bonded | A | above 50 | 148 | 272 |
| 22 | Nylon 50 deniers/2<br>Rubber thread with a diameter of 0.21cm | 2,100<br>700 | Simultaneous windings, synthetic leather bonded | A–B | above 50 | 138 | 270 |
| 23 | Nylon 50 deniers/2<br>Nylon 100 denier crimped thread<br>Rubber thread of 0.21 mm in diameter | 1,962<br>654<br>654 | Simultaneous windings, natural leather bonded | A | above 50 | 144 | 274 |
| 24 | Nylon 50 deniers/2<br>Nylon 100 denier cimped thread<br>Rubber thread of 0.17 mm in diameter | 1,962<br>654<br>654 | Simultaneous windings, natural leather bonded | A | above 50 | 142 | 271 |
| Prior art article | Nylon 50 deniers/2 | 2,800 | Natural leather bonded | C–D | above 50 | 137 | 268 |

What is claimed is:

1. A ball of the inflatable type consisting essentially of a hollow rubber tube used as a ball substrate which is inflated with a gas under pressure, a reinforcing thread winding layer formed by winding a reinforcing nylon filament thread and a rubber thread simultaneously with each other along the outer periphery of said rubber tube, and a surface cover layer covering said reinforcing thread winding layer therewith through an adhesive, said surface cover layer being made of a natural or synthetic leather stock.

2. A ball of the inflatable type consisting essentially of a hollow rubber tube used as a ball substrate which is inflated with gas under pressure, a reinforcing thread winding layer formed by winding a reinforcing nylon filament thread and a rubber thread simultaneously with each other along the outer periphery of the rubber tube, an intermediate rubber layer formed on the surface of said reinforcing thread winding layer by molding and vulcanization, and a surface cover layer bonded to the entire surface of said intermediate rubber layer through an adhesive layer, said surface cover layer being made of a natural or synthetic leather stock.

3. A ball of the inflatable type consisting essentially of a hollow rubber tube used as a ball substrate which is inflated with a gas under pressure, a reinforcing thread winding layer formed by winding a reinforcing nylon filament thread and an urethane elastomer thread simultaneously with each other along the outer periphery of said rubber tube, and a surface cover layer covering said reinforcing thread winding layer therewith through an adhesive, said surface cover layer being made of a natural or synthetic leather stock.

4. A ball of the inflatable type consisting essentially of a hollow rubber tube used as a ball substrate which is inflated with a gas under pressure, a reinforcing thread winding layer formed by winding a reinforcing nylon filament thread and an urethane elastomer thread simultaneously with each other along the outer periphery of said rubber tube, an intermediate rubber layer formed on the surface of said reinforcing thread winding layer by molding and vulcanization, and a surface cover layer bonded to the entire surface of said intermediate rubber layer through an adhesive layer, said surface cover layer being made of a natural or synthetic leather stock.

* * * * *